US010030291B2

(12) United States Patent
Shiraki et al.

(10) Patent No.: US 10,030,291 B2
(45) **Date of Patent: *Jul. 24, 2018**

(54) HIGH-STRENGTH STEEL SHEET EXCELLENT IN SEAM WELDABILITY

(75) Inventors: Atsuhiro Shiraki, Kakogawa (JP); Yukihiro Utsumi, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/547,713

(22) Filed: Jul. 12, 2012

(65) Prior Publication Data

US 2013/0040165 A1 Feb. 14, 2013

(30) Foreign Application Priority Data

Aug. 10, 2011 (JP) ..... 2011-175281

(51) Int. Cl.
*C22C 38/04* (2006.01)
*C22C 38/06* (2006.01)
(Continued)

(52) U.S. Cl.
CPC ..... *C22C 38/14* (2013.01); *C21D 1/18* (2013.01); *C21D 1/25* (2013.01); *C21D 6/005* (2013.01); *C21D 8/0205* (2013.01); *C21D 8/0226* (2013.01); *C22C 38/001* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C22C 38/42* (2013.01); *C22C 38/50* (2013.01); *C22C 38/54* (2013.01); *C23C 2/06* (2013.01); *C23C 2/28* (2013.01); *C21D 2211/008* (2013.01); *Y10T 428/12799* (2015.01)

(58) Field of Classification Search
CPC ..... C22C 38/02; C22C 38/04
See application file for complete search history.

(56) References Cited

U.S. PATENT DOCUMENTS 8,449,988 B2 * 5/2013 Shiraki et al. ..... 428/659
2006/0185774 A1 8/2006 Nishibata et al.
(Continued)

FOREIGN PATENT DOCUMENTS

CN 101910438 A 12/2010
CN 102234743 A 11/2011
(Continued)

OTHER PUBLICATIONS

Machine translation JP2006-274335A. Oct. 2006.*
(Continued)

*Primary Examiner* — Xiaowei Su
(74) *Attorney, Agent, or Firm* — Oblon, McClelland, Maier & Neustadt, L.L.P.

(57) ABSTRACT

Disclosed is a high-strength steel sheet having a tensile strength of 1180 MPa or more and having satisfactory seam weldability. The steel sheet has a chemical composition of C: 0.12% to 0.40%, Si: 0.003% to 0.5%, Mn 0.01% to 1.5%, Al: 0.032% to 0.15%, N: 0.01% or less, P: 0.02% or less, S: 0.01% or less, Ti: 0.01% to 0.2% or less, and B: 0.0001% to 0.01%, with the remainder including iron and inevitable impurities, has a Ceq1 (=C+Mn/5+Si/13) of 0.50% or less, and has a steel structure of a martensite single-phase structure.

23 Claims, 3 Drawing Sheets

(51) Int. Cl.

| | |
|---|---|
| ***C22C 38/08*** | (2006.01) |
| ***C22C 38/32*** | (2006.01) |
| ***C22C 38/16*** | (2006.01) |
| ***C22C 38/02*** | (2006.01) |
| ***B32B 15/00*** | (2006.01) |
| ***C22C 38/14*** | (2006.01) |
| ***C21D 6/00*** | (2006.01) |
| ***C21D 8/02*** | (2006.01) |
| ***C23C 2/06*** | (2006.01) |
| ***C23C 2/28*** | (2006.01) |
| ***C21D 1/18*** | (2006.01) |
| ***C21D 1/25*** | (2006.01) |
| ***C22C 38/00*** | (2006.01) |
| ***C22C 38/12*** | (2006.01) |
| ***C22C 38/42*** | (2006.01) |
| ***C22C 38/50*** | (2006.01) |
| ***C22C 38/54*** | (2006.01) |

(56) References Cited

U.S. PATENT DOCUMENTS

| | | | | |
|---|---|---|---|---|
| 2007/0269678 | A1 | 11/2007 | Ono et al. | |
| 2008/0226491 | A1 | 9/2008 | Satou et al. | |
| 2008/0286603 | A1* | 11/2008 | Oh et al. | 428/684 |
| 2010/0026048 | A1* | 2/2010 | Vlot | B32B 15/013 296/193.01 |
| 2010/0080728 | A1 | 4/2010 | Ikeda et al. | |
| 2011/0048589 | A1* | 3/2011 | Matsuda et al. | 148/645 |
| 2011/0287280 | A1* | 11/2011 | Shiraki et al. | 428/615 |
| 2012/0009434 | A1* | 1/2012 | Hata et al. | 428/577 |
| 2012/0175028 | A1 | 7/2012 | Matsuda et al. | |

FOREIGN PATENT DOCUMENTS

| | | | | |
|---|---|---|---|---|
| EP | 2 339 044 | A1 | | 6/2011 |
| GB | 2483953 | A | | 3/2012 |
| JP | 1-205032 | A | | 8/1989 |
| JP | 7-197183 | | | 8/1995 |
| JP | 9-104921 | A | | 4/1997 |
| JP | 10-60574 | A | | 3/1998 |
| JP | 2002-363650 | | | 12/2002 |
| JP | 2003-96536 | A | | 4/2003 |
| JP | 2003-171730 | A | | 6/2003 |
| JP | 2006-274335 | A | | 10/2006 |
| JP | 2007302974 | A | * | 11/2007 |
| JP | 2008-169475 | | | 7/2008 |
| JP | 2009-7653 | A | | 1/2009 |
| JP | 2009-228134 | A | | 10/2009 |
| JP | 2009228134 | A | * | 10/2009 |
| JP | 2010-132945 | A | | 6/2010 |
| JP | 2010121191 | A | * | 6/2010 |
| JP | 2011-47034 | | | 3/2011 |
| WO | WO 2009/082091 | A1 | | 7/2009 |
| WO | WO 2011/061812 | A1 | | 5/2011 |

OTHER PUBLICATIONS

Machine translation of JP2010-132945A. Jun. 2010.*
Machine translation of JP2007-302974A, Nov. 2007.*
Machine translation of JP 2009228134 A, Oct. 2009.*
Machine translation of JP 2010121191 A. Jun. 2010.*
U.S. Appl. No. 13/099,616, filed May 3, 2011, US2011/0287280 A1, Shiraki, et al.
Combined United Kingdom Search and Examination Report dated Oct. 8, 2012 in Patent Application No. GB1214327.7.

* cited by examiner

HIGH-STRENGTH STEEL SHEET EXCELLENT IN SEAM WELDABILITY

FIELD OF THE INVENTION

The present invention relates to a high-strength steel sheet excellent in seam weldability. Specifically, the present invention relates to a high-strength steel sheet having a tensile strength of 1180 MPa or more and being excellent in seam weldability.

BACKGROUND OF THE INVENTION

For more satisfactory safety and lighter weight of automobiles, automotive steel sheets should have higher and higher strengths in recent years. Independently, such steel sheets should have excellent weldability upon manufacture of automotive steel parts. Demands are therefore made to provide steel sheets having both high strengths and excellent weldability. For allowing steel sheets to have higher strengths, increase in amounts of alloy compositions is generally performed. However, the increase in amounts of alloy compositions often causes the steel sheets to have inferior weldability.

For ensuring excellent weldability, it is preferred to allow a steel sheet to be a low-alloy steel (to reduce amounts of alloy compositions). For ensuring both excellent weldability and a high strength, steel sheets are allowed to have a martensite single-phase structure as the structure so as to be high-strength steel sheets (particularly steel sheets having tensile strengths of 1180 MPa or more) with low-alloy compositions.

Some high-strength steel sheets are subjected to seam welding upon processing into part shapes. The seam welding is a kind of resistance welding, and exemplary resistance welding techniques further include spot welding, in addition to seam welding. In the spot welding, welding is performed while sandwiching a steel sheet by electrodes at one point, and the work is air-cooled immediately after heat input. In contrast, in the seam welding, welding is performed in the form of a line while pinching a steel sheet by electrode wheels, in which a weld bead formed in the early stages of welding is affected by heat input of another weld bead being subsequently welded. The seam welding therefore differs in heat input process from the spot welding. The seam welding also differs in welding conditions, in which welding is performed continuously and this causes a shunt current to an already-formed nugget.

As is described above, a steel sheet preferably has a low-alloy composition for ensuring excellent weldability. However, even such a martensite steel sheet (high-strength steel sheet), when subjected to seam welding, suffers from an insufficient peel strength of a weld bead (hereinafter also referred to as a "seam weld bead"). To avoid this problem, the high-strength steel sheet should give seam weld beads having a higher peel strength. In addition, the high-strength steel sheet desirably gives seam weld beads having satisfactory bending workability.

An exemplary technique relating to martensite steel sheets having low-alloy composition is as follows. Japanese Unexamined Patent Application Publication (JP-A) No. H07-197183 discloses a steel sheet having a martensite-based structure, in which Fe—C precipitates are controlled so as to avoid hydrogen embrittlement. This technique, however, never makes considerations about weldability (particularly properties of seam weld beads when subjected to seam welding).

An exemplary technique relating to resistance welding is as follows. U.S. Unexamined Patent Application Publication No. 2007/0269678 describes a technique of improving the bonding strength of weld beads by controlling the amount of Mn to be added. This technique, however, is not examined specifically on seam welding among the resistance welding techniques, and the chemical composition disclosed therein is probably not suitable for seam welding.

Japanese Unexamined Patent Application Publication (JP-A) No. 2002-363650 describes a technique for improving seam weldability by controlling a Si content. This technique makes a specific consideration on reduction in hardness of nuggets formed after seam welding, but fails to examine the peel strength and the workability of seam weld beads.

SUMMARY OF THE INVENTION

The present invention has been made under these circumstances, and an object of the present invention is to provide a steel sheet which has a high strength in terms of tensile strength of 1180 MPa or more and gives seam weld beads having a high peel strength (hereinafter this property is also referred to as "excellent seam weldability"). Another object of the present invention is to provide a steel sheet which gives seam weld beads having satisfactory workability, in addition to the above properties.

Solution to Problem

The present invention achieves the objects and provides a steel sheet, the steel sheet having a chemical composition of:

carbon (C) in a content of from 0.12% to 0.40% (percent by mass, hereinafter the same is applied to contents in the chemical composition), silicon (Si) in a content of from 0.003% to 0.5%, manganese (Mn) in a content of from 0.01% to 1.5%, aluminum (Al) in a content of from 0.032% to 0.15%, nitrogen (N) in a content of 0.01% or less, phosphorus (P) in a content of 0.02% or less, sulfur (S) in a content of 0.01% or less, titanium (Ti) in a content of from 0.01% to 0.2%, and boron (B) in a content of from 0.0001% to 0.01%, with the remainder including iron and inevitable impurities.

The steel sheet having a Ceq1 expressed by following Equation (1) of 0.50% or less, the steel sheet has a steel structure including 94 percent by area or more of a martensite structure, and the steel sheet has a tensile strength of 1180 MPa or more:

$$Ceq1=C+Mn/5+Si/13 \quad (1)$$

wherein symbols "C", "Mn", and "Si" represent the carbon content (%), the manganese content (%), and the silicon content (%), respectively, in the steel.

The steel sheet preferably further has a Ceq2 expressed by following Equation (2) of 0.43% or less:

$$Ceq2+Mn/7.5 \quad (2)$$

wherein symbols "C" and "Mn" represent the carbon content (%) and the manganese content (%), respectively, in the steel. The steel sheet may further contain chromium (Cr) in a content of from 0.01% to 2.0%.

The steel sheet may further contain at least one of copper (Cu) in a content of from 0.01% to 0.5% and nickel (Ni) in a content of from 0.01% to 0.5%.

The steel sheet may further contain at least one of vanadium (V) in a content of from 0.003% to 0.1% and niobium (Nb) in a content of from 0.003% to 0.1%.

The present invention also includes a hot-dip galvanized steel sheet prepared through hot-dip galvanization of the steel sheet; and a hot-dip galvannealed steel sheet prepared through hot-dip galvanization and subsequent alloying of the high-strength steel sheet.

The present invention can provide a steel sheet which has a high strength of 1180 MPa or more and gives seam weld beads having a high peel strength. In addition, the present invention can provide a steel sheet which has satisfactory workability of seam weld beads, in addition to the above properties. The steel sheets are useful for the manufacture of automotive high-strength steel parts, such as bumpers, which should have a high strength and should give seam weld beads having a high peel strength (in addition, should give seam weld beads having satisfactory workability).

DESCRIPTION OF THE PREFERRED EMBODIMENTS

After intensive investigations to achieve the objects, the present inventors found that, for ensuring a satisfactory peel strength of a seam weld bead of a high-strength steel sheet, it is particularly important to allow the steel sheet to have a chemical composition and to control Ceq1 both as mentioned below; and found that it is particularly important to control the Mn content to be 1.5% or less for allowing the steel sheet to have a relatively low-alloy composition and to give seam weld beads having a high peel strength. The present invention has been made based on these findings. The present invention will be illustrated in detail below.

[Ceq1(C+Mn/5+Si/13) of 0.50% or Less]

Exemplary strength parameters of weld beads for the evaluation of weldability include peel strength and shear tensile strength. The present inventors examined seam weld beads of customary steel sheets on these strengths and found that some of the customary steel sheets have insufficient peel strengths although having high shear tensile strengths.

Based on this finding, the present inventors made further investigations as follows, so as to provide a steel sheet giving weld beads having both a high shear tensile strength and a high peel strength. Specifically, the present inventors made investigations on how the peel strength of a seam weld bead varies depending on the contents of chemical composition in the steel, so as to determine an equation having a correlation with the peel strength of the seam weld bead. The equation is determined based on the equation of carbon equivalent which is generally believed to affect the weldability. As a result, the present inventors initially found that Ceq1 expressed by Equation (1) shown below has a correlation with the peel strength of a seam weld bead, in which Equation (1) employs the contents of C, Mn, and Si as variables.

Figure 1:
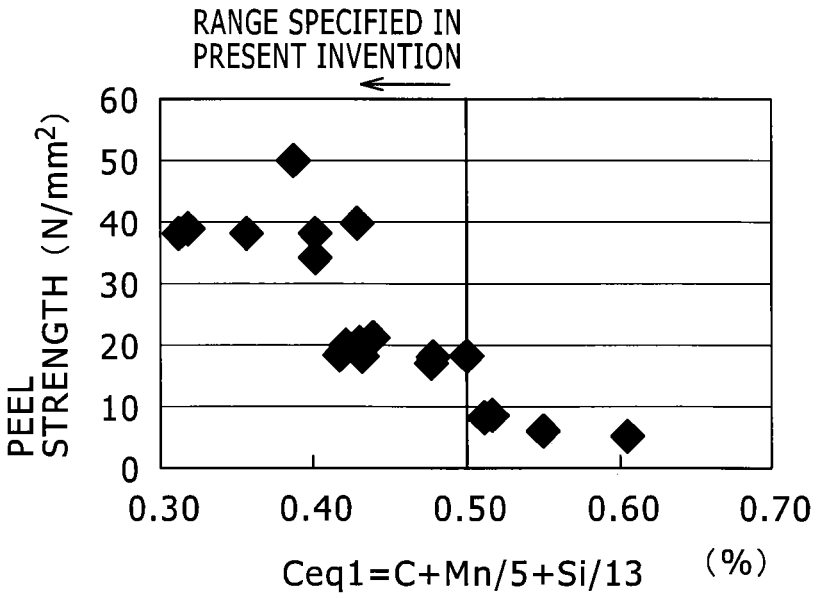
FIG. 1 is a graph illustrating how the peel strength of a seam weld bead varies depending on Ceq1 specified in the present invention.

Next, the present inventors investigated within what range the Ceq1 should be so as to allow the seam weld bead to have a peel strength of 10 $N/mm^2$ or more. Specifically, seam welding was performed using steel sheets having different Ceq1s according to a process described later in the experimental examples to give seam weld beads; the peel strengths of the seam weld beads were measured, and a relationship between the Ceq1 and the peel strengths of the seam weld beads was plotted. The results are indicated in FIG. 1. All data used in FIG. 1 are of specimens containing C, Mn, and Si in contents within the ranges of compositions mentioned later.

FIG. 1 demonstrates that the peel strength tends to increase with a decreasing Ceq1; and that Ceq1 may be set to 0.50% or less so as to allow the seam weld bead to have a peel strength of 10 $N/mm^2$ or more. Ceq1 is preferably 0.48% or less, more preferably 0.45% or less, furthermore preferably 0.43% or less, and still more preferably 0.40% or less. The lower limit of Ceq1 is not critical and may be about 0.12% in consideration of the range of the chemical compositions as specified in the present invention.

$$Ceq1=C+Mn/5+Si/13 \quad (1)$$

In Equation (1), symbols "C", "Mn", and "Si" represent the carbon content (%), the manganese content (%), and the silicon content (%), respectively, in the steel.

In addition, the present inventors found that control of the following Ceq2 allows the seam weld bead to have satisfactory workability.

[Ceq2(C+Mn/7.5) of 0.43% or Less]

The present inventors made further investigations as mentioned below so as to provide a steel sheet which has satisfactory workability of seam weld beads, in addition to the aforementioned properties. Specifically, the present inventors investigated how the workability of a seam weld bead varies depending on the contents of chemical compositions in the steel. As a result, they initially found that a Ceq2 expressed by following Equation (2) has a correlation with the workability of the seam weld bead, in which Equation (2) employs the contents of C and Mn as variables.

Next, the present inventors investigated within what range the Ceq2 should be so as to allow the seam weld bead to have, as workability, a "critical bending radius $R(R_L)/t$ of less than 5.0" described later. Specifically, seam welding was performed using steel sheets having different Ceq2s according to a process described later in the experimental examples to give seam weld beads; the seam weld beads were subjected to bending tests, and a relationship between the Ceq2 and the $R_L/t$ was plotted. The results are indicated in FIG. 2.

Figure 2:
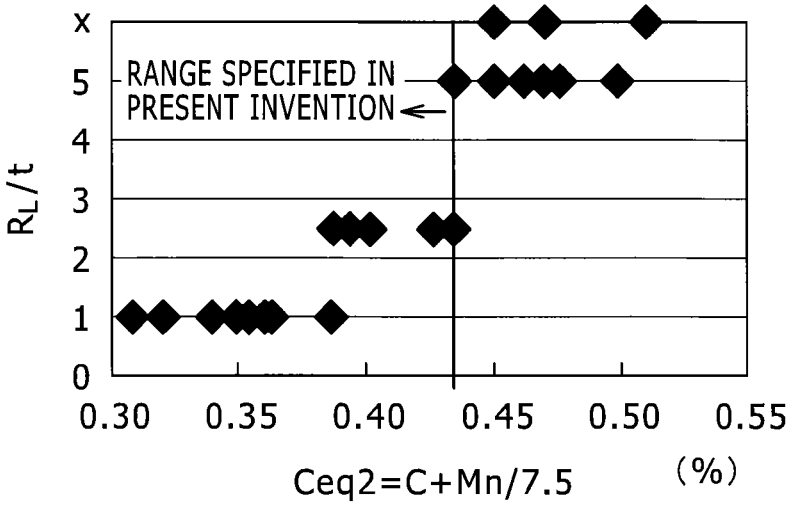
FIG. 2 is a graph illustrating how $R_L/t$ varies depending on Ceq2 specified in the present invention.

FIG. 2 demonstrates that the $R_L/t$ tends to decrease with a decreasing Ceq2 and that the Ceq2 is to be set to 0.43% or less so as to surely achieve a $R_L/t$ of less than 5.0. Ceq2 is more preferably 0.41% or less, and furthermore preferably 0.39% or less. The lower limit of Ceq2 is not limited and may be about 0.12% in consideration of the range of the chemical compositions as specified in the present invention $$Ceq2=C+Mn/7.5 \quad (2)$$

In Equation (2), symbols "C" and "Mn" represent the carbon content (%) and the manganese content (%), respectively, in the steel.

According to the present invention, the Ceq1 is controlled to allow the seam weld bead to have a high peel strength. In a preferred embodiment, the Ceq2 is further controlled to allow the seam weld bead to have satisfactory workability. In addition, the contents of respective elements in the steel sheet should be controlled as mentioned below, so as to allow the steel sheet to surely have a high strength in terms of tensile strength of 1180 MPa or more and to have other properties (e.g., toughness and ductility) required of steel sheet without impairing the aforementioned properties.

[Carbon (C) in a Content of 0.12% to 0.40%]

Carbon (C) element is necessary for increasing hardenability and ensuring a high strength and is contained in a content of 0.12% or more (preferably 0.15% or more, and more preferably 0.20% or more). However, carbon, if contained in excess, may cause the seam weld bead to have a low peel strength, may cause the base metal and the weld bead to have low toughness, and may often cause delayed fracture in a quenched portion. To avoid these, the carbon content is 0.40% or less, preferably 0.36% or less, more preferably 0.33% or less, and furthermore preferably 0.30% or less.

[Silicon (Si) in a Content of 0.003% to 0.5%]

Silicon (Si) element is effective for satisfactory resistance to temper softening and is effective for improving the strength through solid-solution strengthening. For exhibiting these advantageous effects, Si is contained in a content of preferably 0.003% or more and more preferably 0.02% or more. However, Si is a ferrite-forming element and, if contained in excess, may cause the steel sheet to have inferior hardenability and to fail to have a sufficiently high strength. To avoid these, the Si content is 0.5% or less, preferably 0.4% or less, more preferably 0.2% or less, furthermore preferably 0.1% or less, and still more preferably 0.05% or less.

[Manganese (Mn) in a Content of 0.01% to 1.5%]

Manganese (Mn) element is effective for improving hardenability and thereby increasing the strength. For exhibiting these advantageous effects, Mn is contained in a content of preferably 0.01% or more, more preferably 0.1% or more, furthermore preferably 0.5% or more, and still more preferably 0.8% or more. However, Mn, if contained in excess, may cause the seam weld bead to have a low peel strength. To avoid this, the Mn content is 1.5% or less and preferably 1.3% or less.

[Aluminum (Al) in a Content of 0.032% to 0.15%]

Aluminum (Al) element serves as a deoxidizer and also has an effect of improving the corrosion resistance of the steel. For exhibiting these advantageous effects sufficiently, Al is contained in a content of preferably 0.032% or more, more preferably 0.050% or more, and furthermore preferably 0.060% or more. However, Al, if contained in excess, may cause the generation of large amounts of carbon-based inclusions to thereby cause surface flaws. To avoid this, the upper limit of the Al content is 0.15%. The Al content is preferably 0.14% or less, more preferably 0.10% or less, and furthermore preferably 0.07% or less.

[Nitrogen (N) in a Content of 0.01% or Less]

Nitrogen (N), if contained in excess, may cause precipitation of nitrides in larger amounts to adversely affect the toughness. To avoid these, the nitrogen content should be 0.01% or less, and is preferably 0.008% or less, and more preferably 0.006% or less. The nitrogen content is generally 0.001% or more in consideration typically of cost in steelmaking.

[Phosphorus (P) in a Content of 0.02% or Less]

Phosphorus (P) element strengthens the steel but lowers the ductility thereof due to brittleness. To avoid this, the phosphorus content is controlled to 0.02% or less. The phosphorus content is preferably 0.01% or less and more preferably 0.006% or less.

[Sulfur (S) in a Content of 0.01% or Less]

Sulfur (S) element forms sulfide inclusions and thereby impairs base metal workability and weldability in overall welding including seam welding. To avoid these, the lower the sulfur content is, the better. In the present invention, the sulfur content is controlled to 0.01% or less, preferably 0.005% or less, and more preferably 0.003% or less.

[Titanium (Ti) in a Content of 0.01% to 0.2%]

Titanium (Ti) element fixes nitrogen as TiN and effectively helps, when added in combination with boron (B), boron to exhibit the best hardenability. In addition, titanium element is effective for improving the corrosion resistance and for increasing the delayed fracture resistance due to the precipitation of TiC. These advantageous effects are effectively exhibited particularly in steel sheets having tensile strengths of more than 980 MPa. For exhibiting these advantageous effects sufficiently, Ti is contained in a content of preferably 0.01% or more, more preferably 0.03% or more, and furthermore preferably 0.05% or more. However, Ti, if contained in excess, may impair the ductility and the base metal workability. To avoid these, the upper limit of the Ti content is 0.2%, and the Ti content is preferably 0.15% or less and more preferably 0.10% or less.

[Boron (B) in a Content of 0.0001% to 0.01%]

Boron (B) element is effective for increasing the hardenability without impairing the peel strength of the seam weld bead. For exhibiting such advantageous effects sufficiently, boron is contained in a content of preferably 0.0001% or more, more preferably 0.001% or more, and furthermore preferably 0.005% or more. However, boron, if contained in excess, may impair the ductility. To avoid this, the upper limit of the boron content is 0.01% or less. The boron content is preferably 0.0080% or less, and more preferably 0.0065% or less.

The steel for use in the present invention has the chemical composition as mentioned above, with the remainder including iron and inevitable impurities. The inevitable impurities may include elements which are brought into the steel typically from raw materials, construction materials, and manufacturing facilities.

The steel sheet may further contain any of (a) Cr; (b) Cu and/or Ni; and (c) V and/or Nb each in a suitable amount, in addition to the aforementioned elements.

[Chromium (Cr) in a Content of 2.0% or Less]

Chromium (Cr) element is effective for increasing the hardenability and thereby increasing the strength. In addition, the Cr element is effective for increasing the resistance to temper softening of the martensite-structure steel. For exhibiting these advantageous effects sufficiently, Cr is contained in a content of preferably 0.01% or more and more preferably 0.05% or more. However, Cr, if contained in excess, may impair the delayed fracture resistance. To avoid this, the Cr content is, in terms of its upper limit, preferably 2.0% or less and more preferably 1.7% or less.

[Copper (Cu) in a Content of 0.5% or Less and/or Nickel (Ni) in a Content of 0.5% or Less]

Copper (Cu) and nickel (Ni) elements are effective for improving the corrosion resistance and thereby improving the delayed fracture resistance. These advantageous effects are effectively exhibited particularly in steel sheets having tensile strengths of more than 980 MPa. For exhibiting the advantageous effects sufficiently, Cu is contained in a content of preferably 0.01% or more and more preferably 0.05% or more; and Ni is contained in a content of preferably 0.01% or more and more preferably 0.05% or more. However, each of these elements, if contained in excess, may lower the ductility and the base metal workability. To avoid these, the Cu and Ni contents are, in terms of their upper limits, preferably 0.5% or less and more preferably 0.4% or less.

[Vanadium (V) in a Content of 0.1% or Less and/or Niobium (Nb) in a Content of 0.1% or Less]

Vanadium (V) and niobium (Nb) elements are both effective for increasing the strength and improving toughness after quenching due to reduction in size of γ (austenite) grains. For exhibiting these advantageous effects sufficiently, vanadium and niobium are contained each in a content of preferably 0.003% or more and more preferably 0.02% or more. However, these elements, if contained in excess, may cause the precipitation typically of carbonitrides in larger amounts and thereby impair the base metal workability and delayed fracture resistance. To avoid these, vanadium and niobium are contained each in a content of preferably 0.1% or less and more preferably 0.05% or less.

For improving the corrosion resistance and delayed fracture resistance, the steel sheet may further contain any of other elements such as Se, As, Sb, Pb, Sn, Bi, Mg, Zn, Zr, W, Cs, Rb, Co, La, Tl, Nd, Y, In, Be, Hf, Tc, Ta, O, and Ca in a total content of 0.01% or less.

[Steel Structure]

The steel sheet according to the present invention has a further higher strength (1180 MPa or more, preferably 1200 MPa or more, and more preferably 1270 MPa or more). Such a high strength is required as a steel sheet typically for automobiles. If the steel sheet has a steel structure including a larger amount of ferrite, the amounts of alloy elements should be increased in order to ensure the high strength. The steel sheet, however, has inferior seam weldability as mentioned above, and the resulting steel sheet may not have both a high strength and excellent seam weldability. For these reasons, the steel sheet according to the present invention is designed to have a martensite single-phase structure so as to reduce the amounts of alloy elements.

As used herein the term "martensite single-phase structure" means that the structure includes a martensite structure in an amount of 94 percent by area or more (preferably 97 percent by area or more, and may be up to 100 percent by area).

In addition to the martensite structure, the steel sheet according to the present invention may further include any of structures inevitably contained during manufacture process (e.g., ferrite structure, bainite structure, and retained austenite structure).

The present invention is not limited in its manufacturing method, but it is recommended to perform an annealing process under conditions mentioned later, so as to easily obtain the steel structure as specified in the present invention. Other conditions than those in the annealing process may be common or general conditions. Typically, when a cold-rolled steel sheet is subjected to an annealing process under the after-mentioned conditions, the cold-rolled steel may be manufactured by steel-making through melting according to a customary procedure, continuously casting the steel to give billets such as slabs, heating the billets to a temperature in the range of from about 1100° C. to about 1250° C., hot rolling, coiling, acid-washing, and cold rolling. It is recommended to perform the subsequent annealing process under the following conditions.

Specifically, the annealing process is preferably performed by holding the cold-rolled steel sheet at an annealing temperature of 850° C. or higher for 5 to 300 seconds so as to give a γ single-phase structure initially. Annealing, if at an annealing temperature of lower than 850° C., may not give a γ single-phase structure, and this may impede the formation of a martensite single-phase structure after rapid cooling.

After the annealing, the steel sheet is preferably rapidly cooled (quenched) from a temperature of 600° C. or higher (quenching start temperature) to room temperature at a cooling rate of 50° C./s or more. This is because, if the rapid cooling is performed from a quenching start temperature of lower than 600° C. or at a cooling rate of less than 50° C./s, a ferrite structure may precipitate and this may impede the formation of a martensite single-phase structure.

After cooling to room temperature as mentioned above, tempering is preferably performed to ensure the toughness of the base metal, in which the steel sheet is reheated to a temperature in the range of from 100° C. to 600° C. and held within this temperature range for 0 to 1200 seconds.

When a hot-dip galvanized steel sheet or a hot-dip galvannealed steel sheet as mentioned below is to be obtained, the annealing process may be performed typically in a hot-dip galvanization line.

The present invention includes not only cold-rolled steel sheets but also hot-rolled steel sheets. The present invention further includes hot-dip galvanized steel sheets (GI steel sheets) which are obtained by subjecting the hot-rolled steel sheets and cold-rolled steel sheets to hot-dip galvanization; and hot-dip galvannealed steel sheets (GA steel sheets) which are obtained by subjecting the hot-rolled steel sheets and cold-rolled steel sheets to hot-dip galvanization and subsequent alloying treatment. By performing such a plating treatment, the resulting steel sheets can have further higher corrosion resistance. The plating treatment and alloying treatment may be preformed under regular conditions.

The high-strength steel sheets according to the present invention are usable for the manufacture of automotive high-strength steel parts including bumping parts such as bumpers, and front and rear side members; pillars such as center pillar reinforcing members; and body-constituting parts such as roof rail reinforcing members, side sills, floor members, and kick-up portions (or kick plates).

EXAMPLES

The present invention will be illustrated in further detail with reference to several experimental examples below. It should be noted, however, that these examples are never intended to limit the scope of the present invention; various alternations and modifications may be made without departing from the scope and spirit of the present invention and fall within the scope of the present invention.

Material steels having chemical compositions given in Table 1 (with the remainder including iron and inevitable impurities) were melted to give ingots. Specifically, the material steels were subjected to primary refining in a converter and to desulphurization in a ladle. Where necessary, the steels after ladle refining were subjected to a vacuum degassing treatment according typically to the RH process. The steels were then subjected to continuous casting according to a common procedure to give slabs. The slabs were subjected sequentially to hot rolling, acid pickling according to a common procedure, and cold rolling and thereby yielded steel sheets 1.0 mm thick. Next, the steel sheets were subjected to continuous annealing. In the continuous annealing, the steel sheets were held at an annealing temperature given in Table 2 for 120 seconds, cooled to a quenching start temperature given in Table 2 at a cooling rate of 10° C./s, then rapidly cooled from the quenching start temperature to room temperature at an average cooling rate of 50° C./s or more, re-heated to a tempering temperature given in Table 2, and held at the temperature for 100 seconds. The hot rolling was performed under the following conditions.

Hot Rolling Conditions

Heating temperature: 1250° C.

Finish temperature: 880° C.

Coiling temperature: 700° C.

Finish thickness: 2.3 to 3.2 mm

The above-prepared steel sheets were examined under the following conditions to evaluate their properties.

[Measurement of Area Percentage of Steel Structure]

A specimen 1.0 mm thick, 20 mm long, and 20 mm wide was prepared, a cross section of which in a direction in parallel with the rolling direction was polished, corroded with a Nital solution (solution of nitric acid in alcohol), and a region at a depth one-fourth the thickness t (t×¼) was observed under a scanning electron microscope (SEM) at a magnification of 1000 times.

In arbitrary ten view fields (each view field having a size of 90 μm wide and 120 μm long), each ten lines were drawn horizontally and vertically, intersection points of the lines where a martensite structure is observed, and intersection points where a structure (ferrite structure) other than martensite is observed were counted, these numbers were divided by the total number of intersection points, and defined as the area percentage of martensite structure and the area percentage of a structure (ferrite structure) other than martensite, respectively. The results are shown in Table 2.

[Evaluation of Tensile Properties]

The tensile strength (TS) was measured in the following manner. A number 5 specimen for tensile tests prescribed in Japanese Industrial Standards (JIS) Z 2201 was sampled from each of the steel sheets so that a direction perpendicular to the steel sheet rolling direction was in parallel with the longitudinal direction of the specimen; and the tensile strength of the specimen was measured in accordance with JIS Z 2241.

In this experimental example, a sample having a tensile strength of 1180 MPa or more was evaluated as having a high strength. The results are indicated in Table 2. For the sake of reference, the yield strengths (YS) and elongation (EL) of the steel sheets were measured, and the results are also indicated in Table 2.

[Seam Welding Conditions]

Seam welding was performed under the following conditions so as to prepare specimens for peel tests, shear tensile tests, and weld bead bending tests mentioned later.

Figure 3:
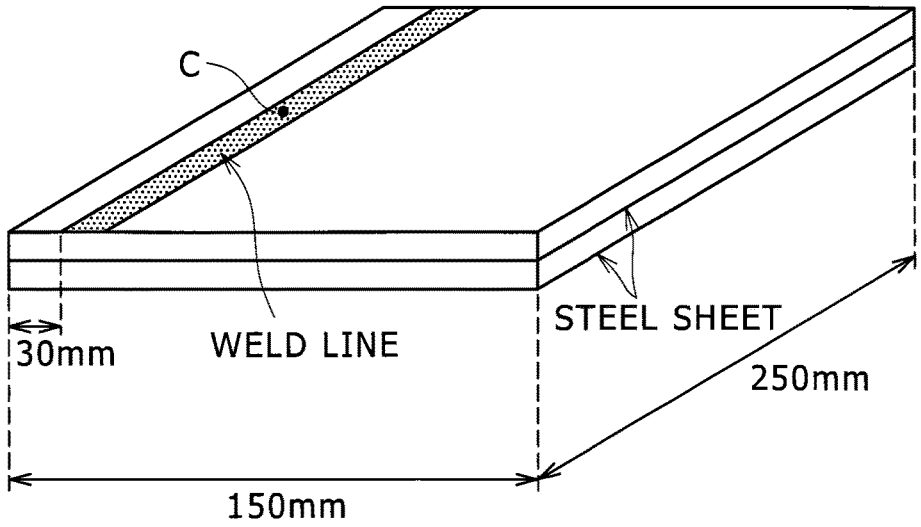
FIG. 3 is a schematic perspective view of a seam-welded specimen for peel tests and bending tests in experimental examples.
Figure 4:
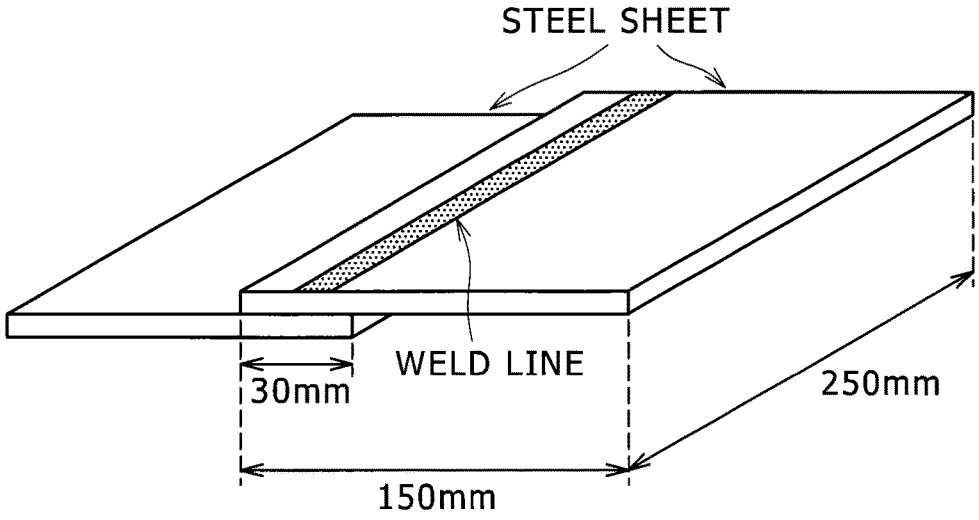
FIG. 4 is a schematic perspective view of a seam-welded specimen for shear tensile tests in the experimental examples.

Specifically, the specimens were cut to a size of 1.0 mm thick, 250 mm long (in the rolling direction), and 150 mm wide (in a direction perpendicular to the rolling direction). Specimens for peel tests and weld bead bending tests were each prepared by placing two plies of a sample steel sheet on each other, and seam welding was performed at a position of 30 mm from the edge of the steel sheets in a direction perpendicular to the rolling direction, as illustrated in FIG. 3. The seam welding was performed under conditions mentioned below. Independently, specimens for shear tensile tests were each prepared by overlapping two plies of a sample steel sheet by 30 mm in a direction perpendicular to the rolling direction of the steel sheet, and performing seam welding at the center of the overlapped region in the rolling direction as illustrated in FIG. 4 under conditions mentioned below.

Seam Welding Conditions

Welding machine: RUG-150V1

Electrode wheels: upper 8 mm, lower 12 mm (flat)

Applied pressure: 900 kgf

Welding current: 14 to 20 kA

Welding speed: 2 m/min

The size of a nugget formed in the weld bead was measured in the following manner. Specifically, a specimen 20 mm wide (in a direction perpendicular to the rolling direction) and 20 mm long (in the rolling direction) was cut from each of the welded sheet specimens (in this experimental example, welded sheet specimens as illustrated in FIG. 4 were used), a cross section perpendicular to the weld line was corroded with a Nital solution, observed under an optical microscope at a magnification of 10 times, and the diameter of a nugget was measured, as prescribed in JIS Z 3141 (1996). As a result, it was verified that all Samples No. 1 to 30 in Tables 1 and 2 have nugget diameters in the range of from 5 to 8 mm, indicating that a nugget is formed normally.

[Peel Test (Measurement of Peel Strength of Seam Weld Bead)]

Figure 5:
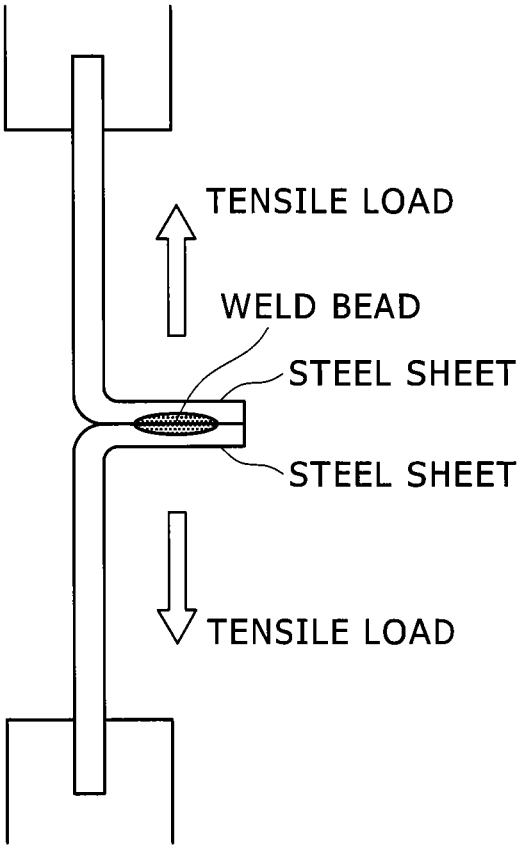
FIG. 5 is a schematic view illustrating how to perform a peel test in the experimental examples.

A specimen 125 mm long (m a direction perpendicular to the rolling direction) and 15 mm wide (in the rolling direction) was cut from each of the welded sheet specimens so that the weld beads of the specimen locate at the central part (C in FIG. 3) of the weld line. The specimen was subjected to bending in which the specimen was bent at 90 degrees while holding the specimen by vises at positions 10 mm from the ends of the weld bead so as to avoid the generation of a strain in the weld bead, to give a peel test specimen as illustrated in FIG. 5. The peel test specimen was subjected to a peel test under following conditions, a maximum load before the weld bead was peeled off was measured, and the maximum load was divided by the nugget cross-sectional area (multiplying the nugget diameter by 15 mm), and the resulting value was defined as a peel strength. Three pieces of the peel test specimen were prepared per one steel type, subjected to the peel tests to determine peel strengths, and the average (n=3) of the peel strengths was calculated and defined as the peel strength of the sample steel sheet.

A sample having a peel strength of 10 $N/mm^2$ or more was defined as having a high peel strength of seam weld bead. The results are given in Table 2.

Peel Test Conditions

Test instrument: 100 kN Autograph Tensile Tester supplied by Shimadzu Corporation Strain rate: 10 mm/min

[Shear Tensile Test]

A specimen according to JIS Z 3136 was prepared from each of the welded sheet specimens and subjected to a shear tensile test under the following conditions, and a maximum load before rupture was measured. Three pieces of the specimen were prepared per one steel type, subjected to the tests, shear tensile strengths were determined, and an average (n=3) of them was calculated and defined as a shear tensile strength of the sample steel sheet.

A sample having a shear tensile strength of 20 kN or more was evaluated as having a high shear tensile strength. The results are indicated in Table 2.

Shear Tensile Test Conditions

Test instrument: 100 kN Autograph Tensile Tester supplied by Shimadzu Corporation Strain rate: 10 mm/min

[Weld Bead Bending Test (Evaluation of Workability of Seam Weld Bead)]

A specimen 30 mm wide (in a direction perpendicular to the rolling direction) and 100 mm long (in the rolling direction) was cut along the weld bead so that the weld bead of the specimen serves as a central axis and that the center of the weld bead of the specimen positions at the central part (C in FIG. 3) of the weld line. The cut specimen was subjected to a weld bead bending test under the following conditions, a largest bending radius at which the bent portion does not suffer from cracking was measured and defined as $R_L$ (critical bending radius R), and the ratio $R_L/t$ of $R_L$ to the thickness t was determined. Three pieces of the specimen were prepared per one steel type, subjected to the tests, the ratios $R_L/t$ were determined, and an average (n=3) of them was calculated and defined as a ratio $R_L/t$ of the sample steel sheet.

A sample having a ratio $R_L/t$ of less than 5.0 was evaluated as having satisfactory workability of the seam weld bead. The results are given in Table 2.

Weld Bending Test Conditions

Test instrument: NC1-80 (2)-B supplied by Aida Engineering, Ltd.

Support-to-support distance: 2R+3t (R: bending radius, t: gage (thickness))

Bending radius: 2R, 3R, 5R, 10R

TABLE 1

| Steel | Chemical composition (mass %) (the remainder including iron and inevitable impurities) | | | | | | | | | | | | | |
|---|---|---|---|---|---|---|---|---|---|---|---|---|---|---|
| No | C | Si | Mn | P | S | Al | N | Ti | B | Cr | Cu | Ni | Nb | V |
| 1 | 0.216 | 0.010 | 0.51 | 0.004 | 0.0020 | 0.065 | 0.0043 | 0.050 | 0.0097 | 0.26 | 0.10 | 0.11 | — | — |
| 2 | 0.210 | 0.010 | 0.51 | 0.004 | 0.0020 | 0.066 | 0.0031 | 0.050 | 0.0017 | 0.08 | 0.10 | 0.11 | — | — |
| 3 | 0.228 | 0.031 | 1.01 | 0.006 | 0.0018 | 0.066 | 0.0050 | 0.048 | 0.0019 | 0.08 | 0.11 | 0.10 | — | — |
| 4 | 0.299 | 0.005 | 1.02 | 0.004 | 0.0020 | 0.064 | 0.0046 | 0.050 | 0.0017 | 0.08 | 0.10 | 0.10 | — | — |
| 5 | 0.321 | 0.003 | 0.54 | 0.004 | 0.0022 | 0.066 | 0.0045 | 0.050 | 0.0016 | 0.07 | 0.10 | 0.10 | — | — |
| 6 | 0.385 | 0.004 | 0.01 | 0.004 | 0.0022 | 0.066 | 0.0046 | 0.050 | 0.0018 | 0.08 | 0.10 | 0.10 | — | — |
| 7 | 0.121 | 0.020 | 1.49 | 0.004 | 0.0018 | 0.034 | 0.0089 | 0.030 | 0.0005 | — | — | — | — | — |
| 8 | 0.134 | 0.493 | 1.23 | 0.005 | 0.0021 | 0.145 | 0.0021 | 0.192 | 0.0054 | 1.95 | — | — | — | — |
| 9 | 0.172 | 0.320 | 1.41 | 0.004 | 0.0091 | 0.032 | 0.0054 | 0.102 | 0.0032 | — | 0.49 | — | — | — |
| 10 | 0.319 | 0.021 | 0.51 | 0.004 | 0.0019 | 0.065 | 0.0045 | 0.020 | 0.0028 | — | — | 0.48 | — | — |
| 11 | 0.218 | 0.121 | 1.02 | 0.005 | 0.0021 | 0.064 | 0.0056 | 0.051 | 0.0062 | — | 0.21 | 0.21 | — | — |
| 12 | 0.245 | 0.012 | 0.78 | 0.019 | 0.0023 | 0.045 | 0.0043 | 0.051 | 0.0028 | — | — | — | 0.05 | — |
| 13 | 0.124 | 0.021 | 1.38 | 0.008 | 0.0022 | 0.132 | 0.0041 | 0.081 | 0.0005 | — | — | — | — | 0.09 |
| 14 | 0.234 | 0.021 | 1.21 | 0.005 | 0.0018 | 0.089 | 0.0034 | 0.124 | 0.0011 | — | — | — | 0.09 | 0.02 |
| 15 | 0.251 | 0.032 | 0.52 | 0.004 | 0.0021 | 0.064 | 0.0047 | 0.051 | 0.0012 | 1.02 | — | — | 0.02 | 0.03 |
| 16 | 0.142 | 0.021 | 1.48 | 0.005 | 0.0018 | 0.145 | 0.0046 | 0.030 | 0.0028 | — | 0.10 | 0.10 | 0.01 | 0.01 |
| 17 | 0.182 | 0.021 | 1.55 | 0.004 | 0.0019 | 0.054 | 0.0042 | 0.032 | 0.0013 | — | — | — | — | — |
| 18 | 0.231 | 0.021 | 2.01 | 0.004 | 0.0021 | 0.065 | 0.0043 | 0.050 | 0.0017 | — | — | — | — | — |
| 19 | 0.323 | 0.031 | 1.12 | 0.004 | 0.0019 | 0.034 | 0.0042 | 0.050 | 0.0005 | 0.08 | — | — | — | — |
| 20 | 0.134 | 0.210 | 2.01 | 0.005 | 0.0018 | 0.064 | 0.0046 | 0.102 | 0.0017 | — | 0.12 | — | — | — |
| 21 | 0.213 | 0.011 | 1.97 | 0.005 | 0.0018 | 0.066 | 0.0047 | 0.030 | 0.0017 | — | — | 0.13 | — | — |
| 22 | 0.232 | 0.012 | 1.78 | 0.005 | 0.0022 | 0.049 | 0.0043 | 0.049 | 0.0017 | — | 0.11 | 0.10 | — | — |
| 23 | 0.312 | 0.021 | 1.01 | 0.004 | 0.0021 | 0.054 | 0.0042 | 0.121 | 0.0082 | 0.07 | 0.10 | 0.10 | — | — |
| 24 | 0.182 | 0.023 | 2.01 | 0.006 | 0.0019 | 0.051 | 0.0046 | 0.050 | 0.0054 | — | — | — | 0.05 | — |
| 25 | 0.159 | 0.032 | 2.01 | 0.004 | 0.0019 | 0.044 | 0.0042 | 0.030 | 0.0016 | — | — | — | — | 0.05 |
| 26 | 0.205 | 0.042 | 1.72 | 0.004 | 0.0021 | 0.066 | 0.0051 | 0.030 | 0.0018 | — | — | — | 0.01 | 0.01 |
| 27 | 0.123 | 0.021 | 1.99 | 0.004 | 0.0021 | 0.049 | 0.0054 | 0.030 | 0.0018 | 0.12 | — | — | 0.01 | 0.01 |
| 28 | 0.415 | 0.012 | 0.35 | 0.005 | 0.0019 | 0.066 | 0.0051 | 0.050 | 0.0037 | 0.07 | 0.10 | 0.10 | — | — |
| 29 | 0.311 | 0.012 | 1.46 | 0.004 | 0.0015 | 0.056 | 0.0045 | 0.050 | 0.0017 | — | — | — | — | — |
| 30 | 0.223 | 0.017 | 1.43 | 0.006 | 0.0016 | 0.065 | 0.0046 | 0.050 | 0.0018 | — | — | — | — | — |

TABLE 2

| Steel | Annealing temperature (° C.) | Quenching start temperature (° C.) | Tempering temperature (° C.) | YP (MPa) | TS (MPa) | EL (%) | Structure | Ceq1 (%) | Ceq2 (%) | Peel test peel strength ($N/mm^2$) | $R_L/t$* | Shear tensile strength (kN) |
|---|---|---|---|---|---|---|---|---|---|---|---|---|
| 1 | 900 | 900 | 200 | 952 | 1297 | 7.7 | martensite 100% | 0.32 | 0.28 | 38.9 | 1.0 | 26.32 |
| 2 | 900 | 660 | 200 | 909 | 1208 | 7.7 | martensite 94% + ferrite6% | 0.31 | 0.28 | 38.2 | 1.0 | 26.21 |
| 3 | 900 | 670 | 200 | 1354 | 1584 | 6.2 | martensite 97% + ferrite 3% | 0.43 | 0.36 | 18.2 | 1.0 | 27.86 |
| 4 | 900 | 900 | 200 | 1428 | 1779 | 5.5 | martensite 100% | 0.50 | 0.44 | 18.3 | 5.0 | 28.20 |
| 5 | 900 | 900 | 200 | 1527 | 1856 | 5.6 | martensite 100% | 0.43 | 0.39 | 39.8 | 2.5 | 26.73 |
| 6 | 900 | 900 | 200 | 1722 | 2000 | 5.4 | martensite 100% | 0.39 | 0.39 | 50.0 | 1.0 | 25.51 |
| 7 | 900 | 800 | 200 | 1111 | 1296 | 6.3 | martensite 100% | 0.42 | 0.32 | 19.1 | 1.0 | 28.21 |
| 8 | 900 | 800 | 200 | 1105 | 1297 | 6.5 | martensite 100% | 0.42 | 0.30 | 18.5 | 1.0 | 28.18 |
| 9 | 900 | 800 | 200 | 1215 | 1447 | 5.6 | martensite 100% | 0.48 | 0.36 | 18.3 | 1.0 | 29.34 |
| 10 | 900 | 800 | 200 | 1422 | 1776 | 5.4 | martensite 100% | 0.42 | 0.39 | 20.1 | 2.5 | 27.84 |
| 11 | 900 | 680 | 200 | 1265 | 1533 | 5.3 | martensite98% + ferrite2% | 0.43 | 0.35 | 20.5 | 1.0 | 28.74 |
| 12 | 900 | 800 | 200 | 1292 | 1582 | 5.2 | martensite 100% | 0.40 | 0.35 | 34.2 | 1.0 | 27.48 |
| 13 | 900 | 800 | 200 | 1103 | 1289 | 6.7 | martensite 100% | 0.40 | 0.31 | 38.2 | 1.0 | 27.92 |

TABLE 2-continued

| Steel | Annealing temperature (° C.) | Quenching start temperature (° C.) | Tempering temperature (° C.) | YP (MPa) | TS (MPa) | EL (%) | Structure | Ceq1 (%) | Ceq2 (%) | Peel test peel strength ($N/mm^2$) | $R_L/t$* | Shear tensile strength (kN) |
|---|---|---|---|---|---|---|---|---|---|---|---|---|
| 14 | 900 | 750 | 200 | 1327 | 1613 | 5.4 | martensite 100% | 0.48 | 0.40 | 17.3 | 2.5 | 28.43 |
| 15 | 900 | 750 | 200 | 1270 | 1560 | 5.7 | martensite 100% | 0.36 | 0.32 | 38.2 | 1.0 | 27.58 |
| 16 | 900 | 750 | 200 | 1157 | 1362 | 6.8 | martensite 100% | 0.44 | 0.34 | 21.3 | 1.0 | 28.83 |
| 17 | 900 | 900 | 200 | 1257 | 1500 | 5.1 | martensite 100% | 0.49 | 0.39 | 9.4 | 2.5 | 26.48 |
| 18 | 900 | 900 | 200 | 1431 | 1728 | 5.4 | martensite 100% | 0.63 | 0.50 | 4.6 | 5.0 | 34.71 |
| 19 | 900 | 800 | 200 | 1515 | 1884 | 5.3 | martensite 100% | 0.55 | 0.47 | 6.3 | x | 28.48 |
| 20 | 900 | 800 | 200 | 1213 | 1419 | 5.6 | martensite 100% | 0.55 | 0.40 | 6.2 | 2.5 | 26.48 |
| 21 | 900 | 800 | 200 | 1385 | 1665 | 5.5 | martensite 100% | 0.61 | 0.48 | 5.1 | 5.0 | 27.95 |
| 22 | 900 | 670 | 200 | 1402 | 1696 | 5.4 | martensite 98% + ferrite 2% | 0.59 | 0.47 | 4.7 | 5.0 | 27.48 |
| 23 | 900 | 800 | 200 | 1475 | 1831 | 5.2 | martensite 100% | 0.52 | 0.45 | 8.9 | x | 28.42 |
| 24 | 900 | 800 | 200 | 1321 | 1572 | 5.4 | martensite 100% | 0.59 | 0.45 | 6.3 | 5.0 | 27.58 |
| 25 | 900 | 750 | 200 | 1269 | 1498 | 5.6 | martensite 100% | 0.56 | 0.43 | 7.8 | 2.5 | 26.12 |
| 26 | 900 | 750 | 200 | 1332 | 1600 | 5.5 | martensite 100% | 0.55 | 0.43 | 6.5 | 2.5 | 27.85 |
| 27 | 900 | 750 | 200 | 1185 | 1380 | 6.3 | martensite 100% | 0.52 | 0.39 | 9.3 | 2.5 | 26.38 |
| 28 | 900 | 750 | 200 | 1629 | 2077 | 5.4 | martensite 100% | 0.48 | 0.46 | 9.5 | 5.0 | 27.75 |
| 29 | 900 | 750 | 200 | 1535 | 1898 | 5.7 | martensite 100% | 0.60 | 0.51 | 5.3 | x | 28.54 |
| 30 | 900 | 750 | 200 | 1333 | 1613 | 5.4 | martensite 100% | 0.51 | 0.41 | 8.5 | 2.5 | 27.63 |

*"x" represents "$R_L/t > 5.0$".

Tables 1 and 2 indicate as follows. Specifically, samples having chemical compositions within the ranges specified in the present invention (Steels Nos. 1 to 16) have high strengths and give seam weld beads having not only high shear tensile strengths but also high peel strengths. Data of Steel No. 4 demonstrate that a steel sheet having a Ceq2 within the recommended range is preferred so as to have satisfactory workability of seam weld bead, in addition to the above properties.

In contrast, samples using steels having chemical compositions out of the ranges specified in the present invention (Steels Nos. 17 to 30) give seam weld beads having insufficient peel strengths, although they give nuggets normally with high shear tensile strengths.

Specifically, Steel No. 17 has an excessively high Mn content and gives a seam weld bead having a low peel strength.

Steels Nos. 18, 20 to 22, and 24 to 27 have excessively high Mn contents and Ceq1s higher than the specific value and give seam weld beads having low peel strengths.

Steels Nos. 19, 23, and 29 and 30 have Ceq1s higher than the specific value and give seam weld beads having low peel strengths.

Steel No. 28 has an excessively high carbon content and gives seam weld beads having a low peel strength Data of Steels Nos. 18, 19, 21 to 24, 28 and 29 demonstrate that steel sheets preferably have a Ceq2 within the recommended range so as to give seam weld beads surely having satisfactory workability.

What is claimed is:

1. A steel sheet, the steel sheet having a chemical composition comprising by mass percent:

carbon (C) in a content of from 0.20% to 0.40%, silicon (Si) in a content of from 0.003% to 0.021%, manganese (Mn) in a content of from 1.01% to 1.5%, aluminum (Al) in a content of from 0.032% to 0.15%, nitrogen (N) in a content of 0.008% or less, phosphorus (P) in a content of 0.02% or less, sulfur (S) in a content of 0.01% or less, titanium (Ti) in a content of from 0.05% to 0.2%, and boron (B) in a content of from 0.0001% to 0.01%, with the remainder comprising iron and inevitable impurities, the steel sheet having a Ceq1 expressed by following Equation (1) of 0.44% or less, the steel sheet having a steel structure including 94 percent by area or more of a martensite structure, and the steel sheet having a tensile strength of 1180 MPa or more:

$$Ceq1=C+Mn/5+Si/13 \quad (1)$$

wherein symbols "C", "Mn", and "Si" represent the carbon content by mass percent, the manganese content by mass percent, and the silicon content by mass percent, respectively, in the steel.

2. The steel sheet according to claim 1, wherein the steel sheet has a Ceq2 expressed by following Equation (2) of 0.43% or less:

$$Ceq2=C+Mn/7.5 \quad (2)$$

wherein symbols "C" and "Mn" represent the carbon content by mass percent and the manganese content by mass percent, respectively, in the steel.

3. The steel sheet according to claim 1, further comprising chromium (Cr) in a content of from 0.01% to 2.0%.

4. The steel sheet according to claim 1, further comprising at least one of copper (Cu) in a content of from 0.01% to 0.5% and Ni in a content of from 0.01% to 0.5%.

5. The steel sheet according to claim 1, further comprising at least one of vanadium (V) in a content of from 0.003% to 0.1% and niobium (Nb) in a content of from 0.003% to 0.1%.

6. A hot-dip galvanized steel sheet comprising:

the steel sheet of claim 1; and a hot-dip galvanized coating formed on the steel sheet through hot-dip galvanization.

7. A hot-dip galvannealed steel sheet comprising:

the steel sheet of claim 1; and a hot-dip galvannealed coating formed on the steel sheet through hot-dip galvanization and subsequent alloying.

8. The steel sheet according to claim 1, wherein the carbon (C) content is from 0.223% to 0.323%, the silicon (Si) content is from 0.012% to 0.021%, and the manganese (Mn) content is from 1.01% to 1.46%.

9. The steel sheet of claim 1, having thickness of from 1.0 mm to 3.2 mm.

10. The steel sheet of claim 1, wherein the steel sheet is a cold rolled steel sheet, a hot-dip galvanized steel sheet, or a hot-dip galvannealed steel sheet.

11. A steel sheet, the steel sheet having a chemical composition comprising by mass percent:

carbon (C) in a content of from 0.223% to 0.323%,
silicon (Si) in a content of from 0.012% to 0.031%,
manganese (Mn) in a content of from 1.01% to 1.46%,
aluminum (Al) in a content of from 0.032% to 0.15%,
nitrogen (N) in a content of 0.008% or less,
phosphorus (P) in a content of 0.02% or less,
sulfur (S) in a content of 0.01% or less,
titanium (Ti) in a content of from 0.05% to 0.2%, and
boron (B) in a content of from 0.0001% to 0.01%,
with the remainder comprising iron and inevitable impurities,
the steel sheet having a Ceq1 expressed by following Equation (1) of 0.48% or less,
the steel sheet having a steel structure including 94 percent by area or more of a martensite structure, and
the steel sheet having a tensile strength of 1180 MPa or more:

$$Ceq1=C+Mn/5+Si/13 \quad (1)$$

wherein symbols "C", "Mn", and "Si" represent the carbon content by mass percent, the manganese content by mass percent, and the silicon content by mass percent, respectively, in the steel.

12. The steel sheet according to claim 11,
wherein the steel sheet has a Ceq2 expressed by following Equation (2) of 0.43% or less:

$$Ceq2=C+Mn/7.5 \quad (2)$$

wherein symbols "C" and "Mn" represent the carbon content by mass percent and the manganese content by mass percent, respectively, in the steel.

13. The steel sheet according to claim 11,
further comprising chromium (Cr) in a content of from 0.01% to 2.0%.

14. The steel sheet according to claim 11,
further comprising at least one of copper (Cu) in a content of from 0.01% to 0.5% and Ni in a content of from 0.01% to 0.5%.

15. The steel sheet according to claim 11,
further comprising at least one of vanadium (V) in a content of from 0.003% to 0.1% and niobium (Nb) in a content of from 0.003% to 0.1%.

16. A hot-dip galvanized steel sheet comprising:
the steel sheet of claim 11; and
a hot-dip galvanized coating formed on the steel sheet through hot-dip galvanization.

17. A hot-dip galvannealed steel sheet comprising:
the steel sheet of claim 11; and
a hot-dip galvannealed coating formed on the steel sheet through hot-dip galvanization and subsequent alloying.

18. The steel sheet of claim 11, wherein the steel sheet is a cold rolled steel sheet, a hot-dip galvanized steel sheet, or a hot-dip galvannealed steel sheet.

19. A steel sheet, the steel sheet having a chemical composition consisting of by mass percent:

carbon (C) in a content of from 0.20% to 0.40%,
silicon (Si) in a content of from 0.003% to 0.032%,
manganese (Mn) in a content of more than 0.8% to 1.5%,
aluminum (Al) in a content of from 0.032% to 0.15%,
nitrogen (N) in a content of 0.008% or less,
phosphorus (P) in a content of 0.02% or less,
sulfur (S) in a content of 0.01% or less,
titanium (Ti) in a content of from 0.01% to 0.2%, and
boron (B) in a content of from 0.0001% to 0.01%, and optionally
at least one selected from the group consisting of Cr, Cu, Ni, and V, wherein chromium (Cr) when present has a content of from 0.01% to 2.0%, copper (Cu) when present has a content of from 0.01% to 0.5%, nickel (Ni) when present has a content of from 0.01% to 0.5%, and vanadium (V) when present has a content of from 0.003% to 0.1%,
with the remainder consisting of iron and inevitable impurities,
the steel sheet having a Ceq1 expressed by following Equation (1) of 0.44% or less,
the steel sheet having a steel structure including 97 percent by area or more of a martensite structure, and
the steel sheet having a tensile strength of 1180 MPa or more:

$$Ceq1=C+Mn/5+Si/13 \quad (1)$$

wherein symbols "C", "Mn", and "Si" represent the carbon content by mass percent, the manganese content by mass percent, and the silicon content by mass percent, respectively, in the steel.

20. A hot-dip galvanized steel sheet comprising:
the steel sheet of claim 19; and
a hot-dip galvanized coating formed on the steel sheet through hot-dip galvanization.

21. A hot-dip galvannealed steel sheet comprising:
the steel sheet of claim 19; and
a hot-dip galvannealed coating formed on the steel sheet through hot-dip galvanization and subsequent alloying.

22. A The steel sheet of claim 19, having thickness of from 1.0 mm to 3.2 mm.

23. The steel sheet of claim 19, wherein the steel sheet is a cold rolled steel sheet, a hot-dip galvanized steel sheet, or a hot-dip galvannealed steel sheet.

* * * * *